US005445081A

United States Patent [19]

Kunczynski

[11] Patent Number: 5,445,081

[45] Date of Patent: Aug. 29, 1995

[54] TRANSIT SYSTEM EMPLOYING A TRACTION BELT

[75] Inventor: Jan K. Kunczynski, Glenbrook, Nev.

[73] Assignee: Yantrak, LLC, Carson City, Nev.

[21] Appl. No.: 227,505

[22] Filed: Apr. 13, 1994

[51] Int. Cl.[6] ..... B61B 13/00

[52] U.S. Cl. ..... 104/165; 104/168; 104/173.1

[58] Field of Search ..... 104/168, 165, 172.3, 104/173.1, 178, 202; 198/835

[56] References Cited

U.S. PATENT DOCUMENTS

| | | | |
|---|---|---|---|
| 255,752 | 4/1882 | Abbott et al. . | |
| 332,934 | 12/1885 | Miller . | |
| 343,293 | 6/1886 | Bowen . | |
| 404,498 | 6/1889 | Pendleton et al. . | |
| 440,001 | 11/1890 | Bryson et al. . | |
| 466,880 | 1/1892 | Hallidie . | |
| 482,279 | 9/1892 | Smith . | |
| 511,596 | 12/1893 | Earll . | |
| 530,720 | 12/1894 | Roe . | |
| 536,611 | 4/1895 | Earll . | |
| 546,955 | 9/1895 | Earll . | |
| 2,372,646 | 4/1945 | Barneby et al. . | |
| 2,386,558 | 10/1945 | Kleintop . | |
| 2,508,216 | 5/1950 | Bonds et al. . | |
| 2,630,206 | 3/1953 | Fergnani . | |
| 2,759,595 | 8/1956 | Lauenstein . | |
| 2,787,366 | 4/1957 | Sykokis . | |
| 2,863,555 | 12/1958 | Jaritz . | |
| 2,933,178 | 4/1960 | Hammond . | |
| 3,211,279 | 10/1965 | Smith . | |
| 3,338,380 | 8/1967 | Grebe . | |
| 3,403,633 | 10/1968 | Schwarzkopf . | |
| 3,508,495 | 4/1970 | Mirel | 104/172.3 |
| 3,537,402 | 11/1970 | Harkess | 104/168 |
| 3,768,624 | 10/1973 | Kornylak | 104/165 |
| 3,797,407 | 3/1974 | Laurent . | |
| 3,880,088 | 4/1975 | Grant | 104/168 |
| 4,092,929 | 6/1978 | Laurent . | |
| 4,361,094 | 11/1982 | Schwarzkopf . | |
| 4,462,314 | 7/1984 | Kunczynski . | |
| 4,848,241 | 7/1989 | Kunczynski . | |
| 4,864,937 | 9/1989 | Kunczynski . | |

FOREIGN PATENT DOCUMENTS

| | | | |
|---|---|---|---|
| 06497677 | 10/1962 | Canada | 104/168 |
| 701740 | 3/1931 | France . | |
| 14208 | of 1889 | United Kingdom . | |

*Primary Examiner*—Mark T. Le
*Attorney, Agent, or Firm*—Flehr, Hohbach, Test, Albritton & Herbert

[57] ABSTRACT

A transit system including a vehicle (21), an elongated flexible traction belt (22) coupled to the vehicle (21) to apply a traction force sufficient to propel the vehicle along a transit path (23), and a drive assembly (24) coupled to displace the traction belt (22). The traction belt (22) is oriented with sides (33) in a substantially vertical plane so that the vehicle (21) can be coupled to one edge (38) of the belt and the other edge (39) used to guide the vertical position of the belt. Intermediate the edges ( 38,39 ) drive assemblies (36,37) can be periodically provided along the length of the transit path (23) to frictionally engage and drive the traction belt without interference from either the guiding surfaces (56,57,58) or the vehicle coupling assembly (51). A method of propelling a vehicle (21) and a traction member-based transit system is provided including a step of applying a traction force to the vehicle ( 21 ) through a traction belt ( 22 ) while the belt is vertically oriented.

20 Claims, 4 Drawing Sheets

TRANSIT SYSTEM EMPLOYING A TRACTION BELT

TECHNICAL FIELD

The present invention relates, in general, to traction member-based transit systems, and more particularly, relates to conveyors for people and freight, such as automated people moving systems, funiculars, cable cars, aerial tramways and similar apparatus, in which a vehicle or carrier unit is pulled or drawn along a transit path by an elongated traction member.

BACKGROUND ART

Haul rope or cable-driven railway transit systems have been in use for many years. U.S. Pat. Nos. 255,752, 332,934, 343,293, 404,498, 440,001, 466,880, 482,279, 511,596, 530,720, 536,611 and 546,955 include examples of such systems which were patented prior to 1900. In each case, a cable or haul rope was used as a traction member to draw a passenger or freight carrying vehicle along a transit path. Such systems have been widely used in many countries, as indicated by French Patent No. 701,740 and British Patent No. 14,208. More recent examples of transit systems employing a traction haul rope can be found in U.S. Pat. Nos. 3,797,407 and 4,092,929.

In the transit or transport systems above referred to, the vehicle or unit being propelled generally is supported on a track, rail or other support surface as it is being propelled by the traction member. It will be appreciated, however, that chair lifts, ski lifts, aerial tramways and similar systems also employ an elongated haul rope or traction member to propel a vehicle or passenger carrier unit along a path, usually without direct support of the vehicle on a track or rail. Typical of the chair lifts and aerial tramways in which a twisted wire haul rope is used as the traction member are the systems disclosed in my U.S. Pat. Nos. 4,462,314, 4,848,241 and 4,864,937, among others.

Considerable technology has been developed, therefore, in connection with driving, gripping, guiding, repairing, replacing and maintaining metallic haul ropes or traction members. Notwithstanding such effort over many years, there are still significant disadvantages which result from using a haul rope traction member in a transport, conveying or transit system. One problem which is commonly encountered is that it is difficult to apply power efficiently to a haul rope at locations other than the ends of the system. Torque transfer is a function of the rope tension, coefficient of friction and the angle of contact with the rope driving wheels. Thus, in most systems large, horizontal, vertical or inclined bull wheels are employed at opposite ends of a looped haul rope to drive the rope. Moreover, in order to create the necessary traction force, the tension on the haul rope must be very high to avoid slipping of the haul rope on the bull wheels. Attempts to add power intermediate the ends by small diameter sheaves have been made, but the torque transfer to the traction member, haul rope, is very inefficient because the contact is essentially a point contact, and wear on the small diameter drive sheaves is very high.

The use of large diameter bull wheels in turn makes it very difficult to advance or propel the vehicles or carrier units past, around or over the traction member drive unit. Funiculars cannot pass around such large bull wheels. In aerial tramways, the problem is often solved by detaching the passenger carrier unit from the haul rope at the ends. In non-detachable chair lifts and the like the passengers usually load and unload before the unit passes around the end bull wheels. In rail-based funicular systems the vehicles are often detached from the haul rope, the haul rope lifted from the drive assembly, or the system run as a shuttle between end terminals containing the drive assemblies.

Still another problem that can occur when driving or supporting rope-like traction members is that the sheave linear velocity cannot be matched to the rope linear velocity over the full contact height. Moreover, traction cable-based systems, even those employing rubber lined sheaves, induce a significant amount of vibration and noise as a result of the twisted strand haul ropes passing rapidly over the rolling support sheaves. Still further, the various couplings of the vehicle to the traction haul rope must be designed to pass over support sheaves, which further increases the system's complexity, as well as passing vibration and noise through to the vehicle or passenger carrier unit.

While considerable problems exist in connection with conventional traction member-based transit systems, they also afford substantial advantages. The traction member can insure very positive control of the position and velocity of the vehicle being propelled over the transit path. Such traction-based systems are well suited for automated or driverless transport of passengers and freight, and they eliminate the necessity of having vehicles with independent on-board power systems. They are adaptable to a wide variety of applications and inherently can provide relatively low cost systems to install and maintain.

While many efforts have been directed to gripping, guiding and driving elongated traction elements, little effort has been directed toward the traction member itself. The primary technological advances in connection with traction members have been directed toward improving the tensile strength of the haul ropes. While significant, it is also highly desirable in terms of safety and structural costs to employ traction members which are not under high tensile loading forces. The solution to improving traction member-based transit systems, therefore, does not appear to ultimately reside in merely increasing the traction member's strength and/or size.

DISCLOSURE OF INVENTION

Accordingly, it is an object of the present invention to provide an improved traction member for transit systems in which vehicles are propelled by drawing or pulling the same along a transit path.

Another object of the present invention is to provide a traction member and method for a transit system in which the driving forces can be distributed around the transit path to enhance redundancy and lower the tension required for the traction member.

A further object of the present invention is to provide an improved transit system in which a traction member is provided which enables more efficient propulsion of the vehicles or carrier units which are attached to and propelled by the traction member.

Still a further object of the present invention is to provide an apparatus and method for propelling vehicles in a transit system which does not require detachment from the traction member to propel or guide the vehicles in a continuous loop system.

A further object of the present invention is to provide a transit system based upon a traction member which system provides a smoother, less noisy means of propulsion, a more efficient driving or coupling of the vehicle to the traction member, a system requiring lower maintenance, and a system suitable for both shuttle and continuous loop operations.

The transit system, traction member, and method of the present invention have other features and objects of advantage which will become apparent from and are set forth in more detail in the following Best Mode of Carrying Out the Invention and the accompanying drawings.

The transit system of the present invention is comprised, briefly, of at least one and preferably a plurality of movable vehicles or carrier units, an elongated flexible traction belt extending along a transit path and coupled to the vehicle to apply a traction force to the vehicle sufficient to propel the vehicle along the path, and a drive assembly coupled to displace the traction belt along the path. The system preferably further includes a belt support assembly which supports the traction belt for movement while the traction belt is oriented in a substantially vertical plane. A guide shoe may be provided on the traction belt so that the support assembly can include guide rollers that maintain the belt in a predetermined vertical position along the path, with both hold-down and support guide rollers engaging the belt-mounted shoe. The method of the present invention is comprised, briefly, of the step of applying a traction force to the transit vehicle through a flexible traction belt, which preferably is oriented in a substantially vertical plane.

BEST MODE OF CARRYING OUT THE INVENTION

Figure 5:
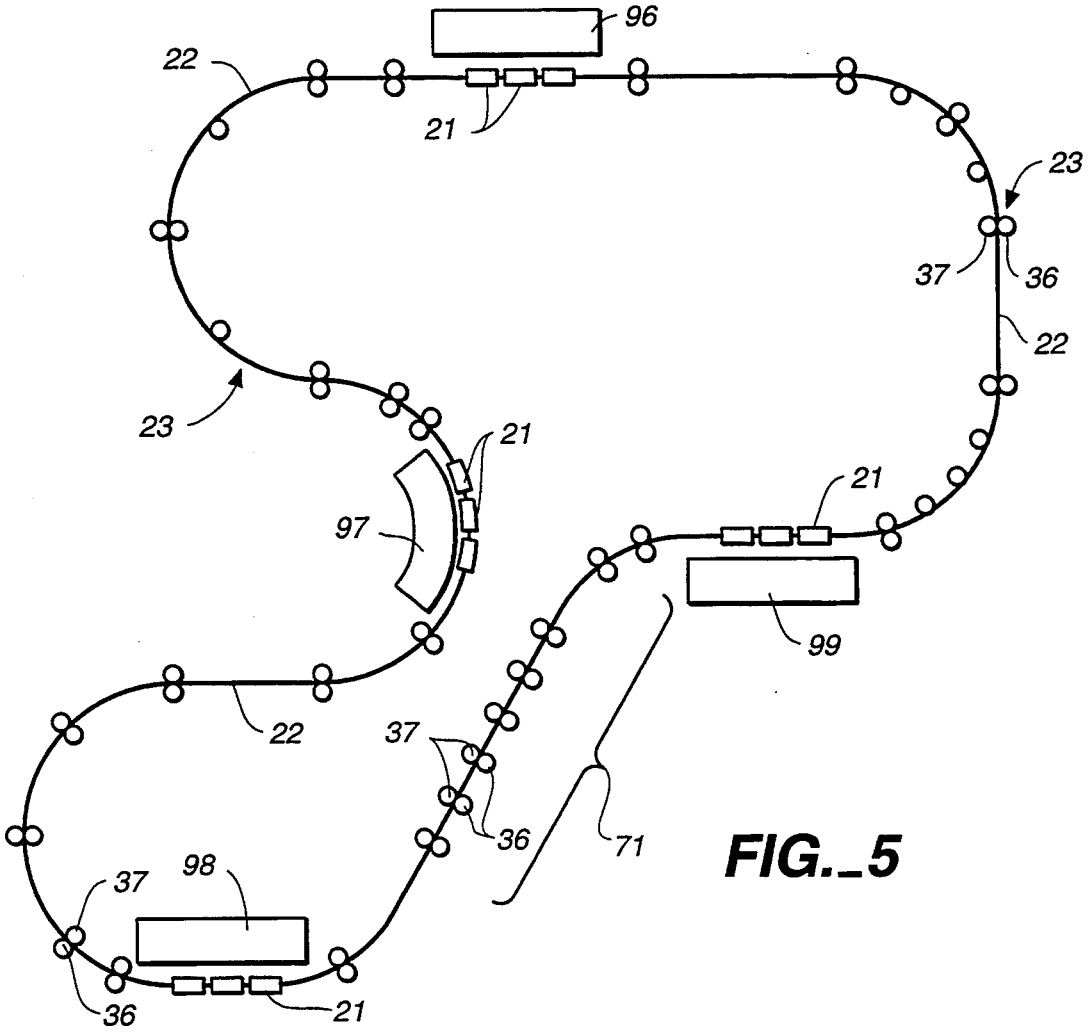
FIG. 5 is a schematic, top plan view of a continuous loop transit system constructed using the traction element of FIG. 2.

The transit system of the present invention is a traction member or element-based transit system in which a movable vehicle or carrier unit, generally designated 21, is coupled to an elongated flexible traction member, generally designated 22, for application of a traction force to the vehicle sufficient to propel the vehicle along a path, such as continuous loop path 23 in FIG. 5. The transit system includes a drive assembly generally designated 24 and preferably a traction element support assembly, generally designated 26.

Instead of using a haul rope or twisted wire cable as the elongated traction member or element 23, the improved transit system of the present invention employs an elongated, flexible, resiliently compressible, traction belt 22. Band-like traction belt 22 has many important advantages over the use of an elongated, cylindrical, traction member, such as a metal or twisted wire haul rope. One of the most important advantages is that driving of traction band or belt 22 by drive assembly 24 can be accomplished much more efficiently with small diameter drive wheels than is possible when driving a haul rope or cylindrical cable.

A traction belt, unlike a cylindrical traction rope, can be efficiently driven by pinching the belt between opposed drive rollers. Pinching a steel rope between two sheaves tends to result in the rope being engaged over a very small area, and the sheaves engaging the rope having an increasing linear speed with the increasing radial distance at which the rope is engaged by the sheaves. The result is rope sheave speed mismatch which greatly increases sheave wear.

A belt can be compressed or pinched between opposed drive wheels and a much larger area engaged and driven, as in a flat belt drive, at the same velocity as the drive wheels. Thus, torque transfer to a belt traction member does not have to be dependent upon the angle of contact, friction force and tension of the traction member, which are the parameters which normally control torque transfer to a haul rope wrapped around a drive or bull wheel.

Moreover, a traction belt can be driven with much less vibration, since it can be very smooth, and the noise level is reduced when a traction belt is employed. Still further, traction belts can be significantly lower in weight than metallic haul ropes, they can be driven at lower tension force, they have less sag in between supports, they can be employed in continuous loop transit paths without detachment of the vehicle.

Figure 2:
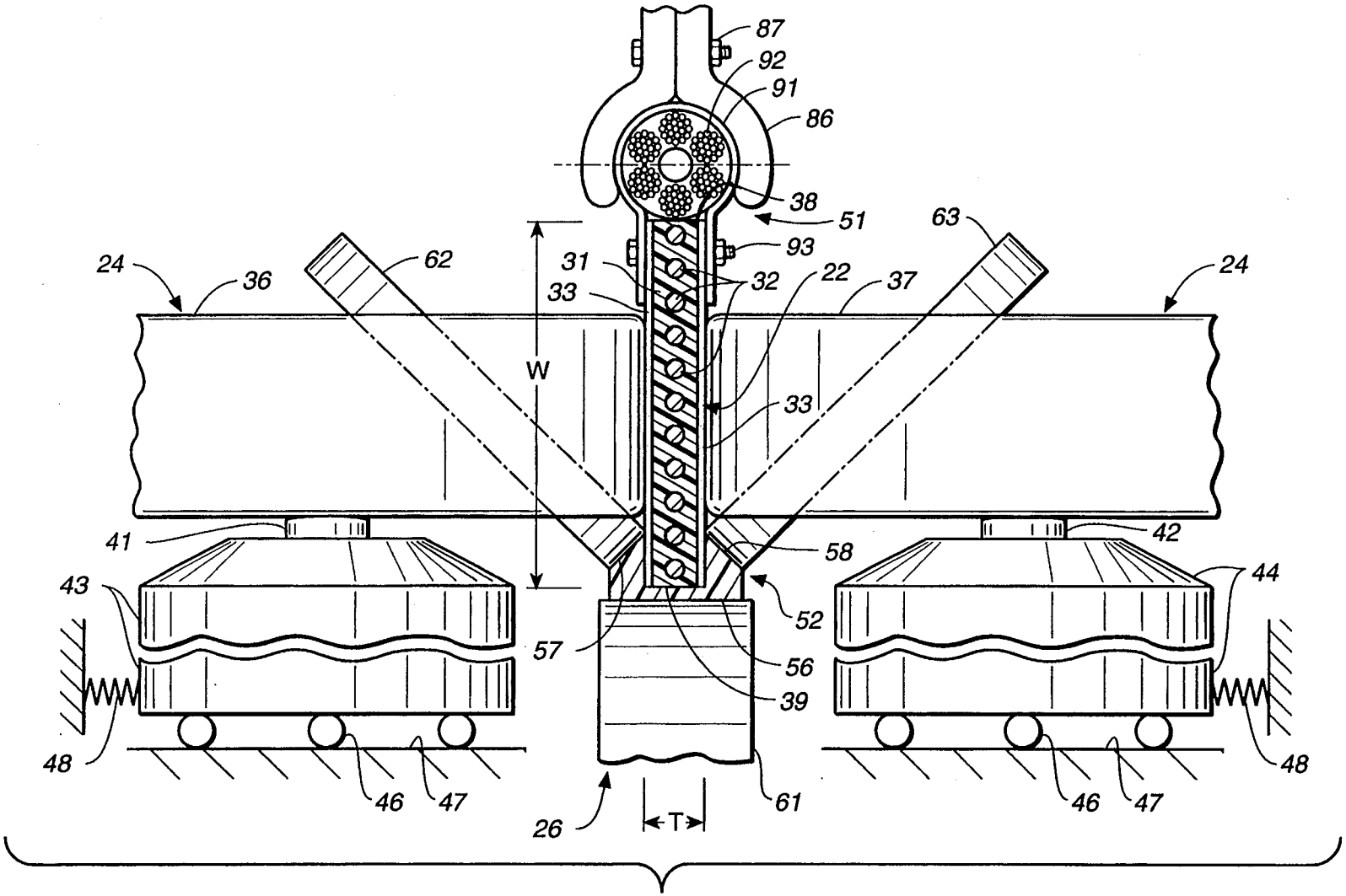
FIG. 2 is an enlarged, fragmentary, front elevational view, in cross section, of the traction element and drive assembly of FIG. 1.
Figure 3:
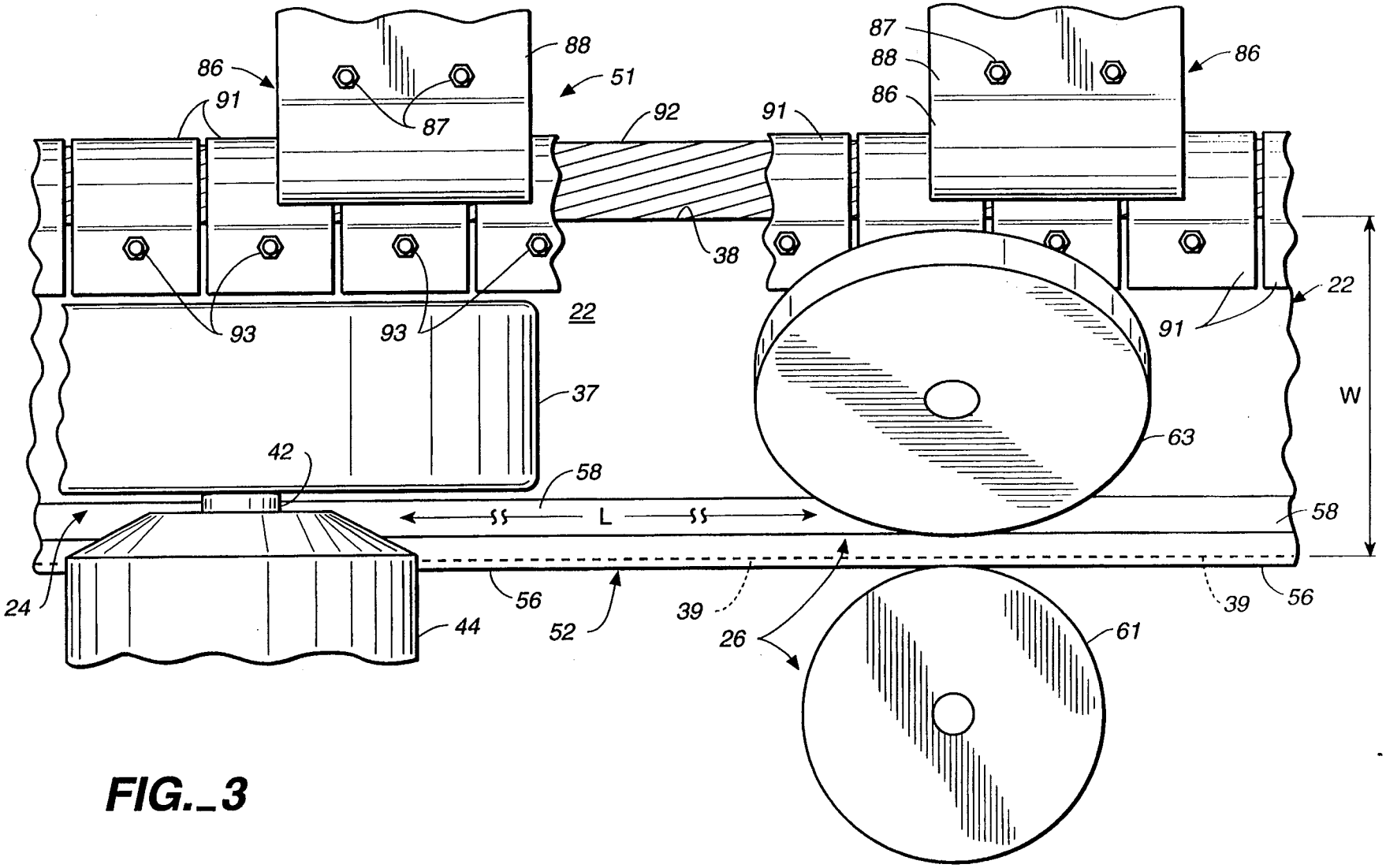
FIG. 3 is a fragmentary, side elevation view of the assembly of FIG. 2.

Referring now to FIGS. 2 and 3, the traction member 22 of the present invention can be described in more detail. As will be seen, belt 22 preferably is formed with a central carcass 31, usually formed of natural or synthetic rubber which may have textile or metal fabric or strands buried in the carcass as reinforcing members. As shown, a plurality of strands 32 run longitudinally inside the carcass 31 and most preferably are provided as metal or steel strands. Steel reinforcing strands are helpful in insuring that band or belt 22 has sufficient tensile strength, but because the use of a belt allows operation of the system under low tension forces, as described in more detail below, the primary advantage of using steel strands may be that they increase the belt's resistance to vandalism. A wear or friction layer 33 can be provided on each of the sides of belt carcass 31 to create the desired coefficient of friction, compressibility and wear life for belt 22.

In the preferred embodiment, drive assembly 24 is comprised of at least one, and preferably a pair, of opposed drive wheels 36 and 37 which frictionally engage and preferably pinch belt 22 intermediate an upper edge 38 and a lower edge 39 of the belt. By selecting the materials and surface configuration of drive wheels 36 and 37, as well as wear traction surfaces 33 and carcass 31, a wide range of resilient compressibility and coefficients of friction can be achieved. Thus, wear layers 33 can have a tread or rib pattern to enhance friction and can be of a relatively soft durometer. Drive wheels 36 and 37 also can be knurled or covered with a natural or synthetic rubber. In the preferred form, however, the drive wheels 36 and 37 are metallic wheels, such as anodized aluminum or stainless steel, for low maintenance. They are smooth or knurled so as to cooperate with friction surfaces 33 on belt 22, but the tension forces required to drive a vehicle are not so high as to require extremely high coefficience of friction between the drive wheels and belt. It is preferred in terms of noise generation to employ a smooth belt, if possible, and the drive wheels preferably are not covered with a rubber or other coating. It is better to wear the belt over its full length than to wear a coating on a small diameter drive wheel.

Unlike cylindrical traction member or haul rope-based traction systems, the drive wheels 36 and 37 pinch and contact belt 22 in the linear-type contact of a flat belt drive. The linear velocity of each of wheels 36 and 37 can be the same as belt 22 over the full width of the belt being engaged by the drive wheels. This allows matching of the drive wheel and belt velocity so as to minimize wear and create a much more efficient transfer of torque from even relatively small diameter wheels 36 and 37 to traction belt 22.

As schematically illustrated, drive wheels 36 and 37 are coupled by shafts 41 and 42 to drive motors 43 and 44. The motors can be mounted before movement, for example, by roller elements 46 on a support surface 4,7 and spring biased at 48 toward each other to pinch traction belt 22 positioned therebetween. Carcass 31 of the belt can be engineered to be resiliently compressible so as to cooperate with the biasing of springs 48 in a manner which further enhances the efficient transfer of torque from drive wheels 36 and 37 to traction belt 22.

In a typical embodiment, belt 22 can have a 7 inch width dimension, drive wheels 36 and 37 can be 12 inches in diameter and driven by 5 horsepower motors 44. Pairs of drive wheels can be spaced along path 23 at about 100–150 foot intervals in level track section.

Figure 1:
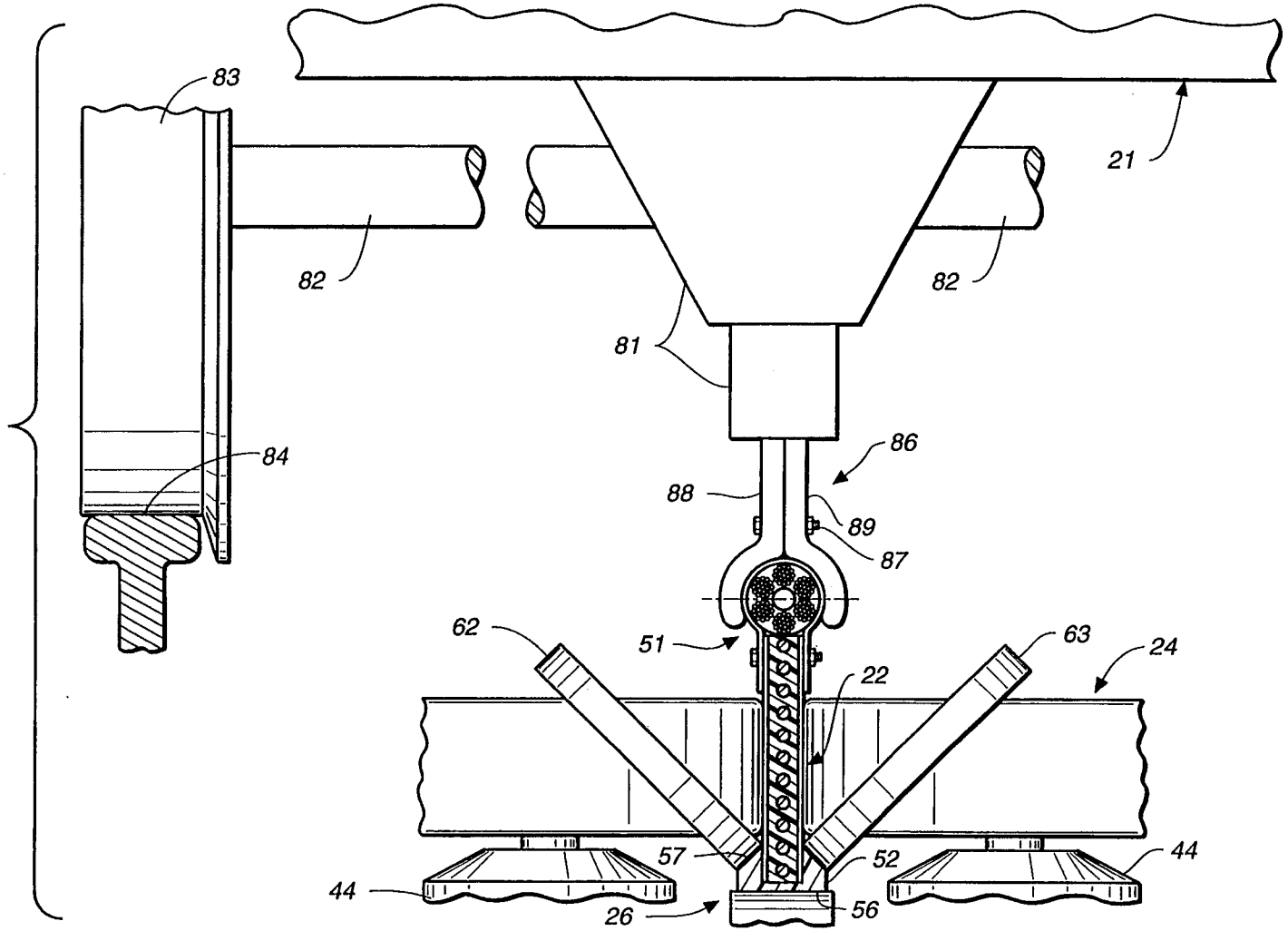
FIG. 1 is a fragmentary, front elevation, schematic representation of a traction member-driven vehicle and drive assembly constructed in accordance with the present invention.

In the preferred form of the transit system of the present invention, traction belt 22 is oriented in a substantially or near vertical plane, as shown in FIGS. 1 and 2. Thus, the drive and guiding assemblies for traction belt 22 preferably orient the traction belt so that the opposed sides 33 are substantially in a vertical plane with edges 38 and 39 oriented in substantially horizontal planes. Belt 22, therefore, will be seen to have width dimension, W, which extends vertically, a thickness dimension, T, which extends horizontally and a length dimension, L, which extends over the length of the transit path 23. This geometry affords traction element 22 very substantial advantages over cylindrical traction haul ropes, and the orientation of the belt in a near vertical plane causes gravity to work with the geometry, as set forth below.

As can be seen in FIGS. 2 and 3, the large width dimension, W, enables upper edge 38 of the haul rope to have a coupling assembly, generally designated 51, mounted thereto for coupling of vehicle 21 to the traction belt. Lower edge 39 of belt 22 can have a guide shoe 52 coupled thereto for guided vertical positioning of belt 22, in a manner which will be described in more detail hereinafter. Intermediate of edges 38 and 39, drive wheels 36 engage and drive belt 22 over substantial belt width (vertical distance in FIGS. 2 and 3). As will be seen, therefore, traction belt 22 can pass between drive rollers 36 and 37 and/or horizontally oriented idler rollers (not shown) without detachment of the vehicle and without having to have the vehicle grip assembly 51 pass between the drive wheels. Moreover, guide shoe 52 can pass beyond drive wheels 36 and 37 without impeding their operation or inducing vibration, jarring or the like. This use of a substantial width dimension W of belt 22 to couple, drive and guide the traction belt enables construction of transit systems as shown in FIG. 5 in which vehicles 21 can be easily driven in continuous loops 23 without detachment structures, traction element lifting structures, drive wheel retracting structures or other special guiding techniques which seek to accommodate passage of the vehicle along the transit path.

Traction belt or band 22 further preferably is moderately flexible so as to accommodate both horizontal and vertical curves, but is sufficiently stiff so that it will not buckle or can be easily supported by drive and idler wheels when in a vertical orientation. As shown in the drawing, wheels 36 and 37 are coupled to motors. It will be understood, however, that similarly oriented idler wheels can also be positioned along path 23 as needed to maintain belt 22 in a vertical orientation without buckling.

One of the problems which occurs with wire haul ropes is that the weight per linear foot can be over four pounds. Accordingly, sagging of the haul rope intermediate support sheaves is a constant problem, which usually is offset by the addition of intermediate, idler support sheaves. Traction belt 22 of the present invention, however, can have a weight of between 1.5 to 2 lbs. per linear foot, or one-half of the weight of a haul rope. Moreover, the orientation of belt 22 in a vertical plane inherently provides the traction belt with a high resistance to vertical sag. Gravity does not produce the extreme sagging which can occur when cylindrical traction members are used. Traction belt supporting wheels in the present system need only prevent buckling and may be located as required when using traction belt 22 of the present invention. It is, however, an important feature of the present invention that traction belt 22 inherently is well suited and affords a position along the belt width at which a guiding adaptation, structure or shoe can be secured for control, with gravity, of the vertical position of vertically oriented belt 22.

One form of guide shoe 52 and guiding assembly 26 is shown in FIGS. 1–3. Guide shoe 52 is preferably provided by a generally triangular, extruded, longitudinally-extending shoe member which has a base or downwardly facing guide surface 56 and two downwardly and outwardly sloping guide surfaces 57 and 58 on opposite sides of belt 22. Shoe 52 can be formed as an extruded thermoplastic or rubber member which is adhesively secured or vulcanized to edge 39 of belt 22. If desired or necessary, staples or other fasteners can be used in combination with adhesives and/or vulcanizing to secure shoe 52 to belt 33.

It is possible to guide belt 22 directly off belt edges 38 and 39, but the provision of a guide shoe 52 ensures smoother and, if desired, softer opposed guide surfaces 56, 57 and 58.

Guide assembly 26 may advantageously include a first roller element 61, which is preferably an idler roller, and which engages downwardly facing, base guiding surface 56. Guide roller 61, the vertical orientation of the elongated belt transverse cross section, and horizontal drive rollers 36 and 37, as well as similar horizontal idler rollers, limit the downward sagging and buckling of belt 22 as the belt is advanced along the transit path. Rollers 61 are positioned periodically along the transit path to assist in the control of sag or to produce an upwardly convex curve in the belt. Additionally, it is preferable that the belt guiding assembly 26 include at least one hold-down idler roller, and preferably two rollers 62 and 63, which engage guiding surfaces 57 and 58, respectively, of shoe 52.

As shown in the drawing, surfaces 57 and 58 and guide rollers 62 and 63 are mounted at about 45° angles to be vertical and are opposed to each other so as to effect the application of a hold-down force which is laterally balanced on either side of belt 33. Rollers 62 and 63, therefore, ensure that in upwardly-concave, vertical curves, valley sections of the transit path, in which the belt does not sag sufficiently of its own weight, the vertical position of the belt can nevertheless be controlled by guide rollers 62 and 63, in combination with support roller 61.

While it is preferred to provide guide rollers 61–63 as idler rollers, it will be understood that there may be instances in which driving of the belt could be accomplished by driving shoe 52 through driven rollers 61–63. Since the contact areas which would be involved are much less than the substantial width dimension, W, available on opposite sides 33 of belt 22, it is much preferable to effect driving through frictional engagement of opposite sides of traction belt 22 by drive rollers 36 and 37.

An additional substantial advantage of vertically orienting traction belt 22 is that water and moisture contacting friction surfaces 33 will tend to run off more rapidly from the traction belt so that friction loss due to moisture is minimized. Another advantage is that the traction belt can be used to drive vehicle 21 from either above or below the vehicle so as to minimize the footprint of the transit path. It will be understood, however, that belt 22 can be oriented in planes other than a vertical plane while still achieving many of the advantages above noted in connection with the use of a belt or band as a traction element.

One of the substantial advantages of using a traction belt in the transit system of the present invention is that the tension on the belt can be greatly reduced over tensions typically employed in haul rope-based transit systems. A typical passenger conveying vehicle capable of holding 20 passengers can be propelled on level rails using a tension force in advance of the vehicle which is only 1,500 to 2,000 lbs. more than the tension force behind the vehicle. This allows a distributed drive system in which pairs of drive wheels 36 and 37 are positioned at virtually any desired spacing along transit path 23 in order to ensure that this relatively low traction force is present at all times. As one pair of drive wheels 36 and 37 applies a traction force of 2,000 lbs. in excess of the force behind the vehicle, these same drive wheels, in effect, produce a slack or reduce the tension upstream of the drive wheels. The next pair of drive wheels, therefore, will have to overcome a relatively low tension force behind the vehicle as it passes beyond the first pair of drive wheels. Thus, if the tension on traction belt 22 behind the vehicle is 500 lbs. or less, drive wheels 36 and 37 need only create a traction force of 2,500 lbs. in front of the vehicle to propel the same. As the vehicle passes beyond the drive wheels 36 and 37, the next pair of drive wheels will pick up the traction force and the last pair will cause the traction belt to slacken behind the vehicle. No single pair of drive wheels is called upon to drive all the vehicles.

Commercially available belts 22 in widths of 7 inches have a tensile rating of 6,000 to 7,000 lbs. achieving a tension difference in front and behind the vehicle of on the order of 1,500 to 3,000 lbs. may be easily accomplished within the rated tensile strength of such belts. In areas where there can be hills, for example, the portion of transit path 23 designated by the number 71 in FIG. 5, drive wheels 36 and 37 can be spaced at closer intervals and apply somewhat greater torque to get larger tension differentials for pulling vehicle 21 up the hill. Conversely, in down hill portions drive wheels can be spaced-apart at greater intervals.

Referring now to FIGS. 1 and 3, one technique for coupling traction belt 22 to vehicle 21 can be described in greater detail. In FIG. 1, vehicle 21 is illustrated as including an under carriage 81 having an axle 82 on which vehicle support wheels 83 are mounted. It will be understood that one-half axles and other independent wheel suspension assemblies can be used. The vehicle illustrated is designed for travel along a rail or track 84, but it will be understood that the traction belt system of the present invention can also be used with vehicles which are not supported on rails 84 or even supported from the ground.

Extending downwardly from under carriage 81 is a clamp assembly 86 which includes clamp members 88 and 89 that can be drawn together, for example, by fastener 87 around a traction belt coupling assembly 51. As best may be seen in FIGS. 2 and 3, grip assembly 51 is comprised of a plurality of side-by-side U-shaped bands 91 which extend around a flexure member 92 and are coupled proximate upper edge 38 of belt 22, for example, by fasteners 93. The plurality of side-by-side bands 91 provides redundancy and allows the traction force induced in belt 22 by drive rollers 36 and 37 to be more evenly transferred to vehicle 21 without undue stress concentrations. In the preferred form, bands 91, and grip assembly 51, extend along a length of belt 22 which is comparable to or greater than the overall length of vehicle 21 being coupled to the belt. Each one of the bands 92 will have a dimension along belt 22 less than the width dimension, W, of the belt in order to permit lateral flexure.

As shown in the drawing, flexure element 92 is a wire strand or rope which can have rubber inserts in the valleys between strands, but it will be understood that flexure element 92 also could be a rod or a bar. It is preferable that flexure element 92 have a flexibility transversely of its longitudinal axis which is less than the flexibility of belt 22 about a central longitudinal axis. As may be seen in FIG. 4, the tendency for flexible traction belt 22 between pairs of drive sheaves 36, 37 and **36*a*, 37*a* is to assume a straight line path between the last contact points 96 and 96*a* with the respective drive wheels. This is particularly true in a traction element system which is under low tension and for drive wheels which are separated by any significant distance. Flexure element 92, however, being stiffer than belt 22 and extending over a substantial length of belt 22, for example, the length of the vehicle, will tend to assume an arcuate position, shown in FIG. 4 for a horizontal curve. This arcuate flexure of element 92, which is accommodated by multiple bands 91, will tend to cause belt 22 to conform to the arc of the stiffer flexure member 92. This in turn will tend to smooth the passage of the vehicle over the various drive and guide rollers during both horizontal and vertical curves. Thus, vehicle grip assembly 51 preferably, although not necessarily, includes a flexure element 92 that is effective in further smoothing the ride in the vehicle in curved transit paths. Obviously, for straight, level shuttle applications a flexure element 92** is not required.

The attachment between coupling assembly 51 and under carriage 81 of the vehicle need not be provided by a set of clamps 88 and 89 for each grip assembly band 91.

Figure 4:
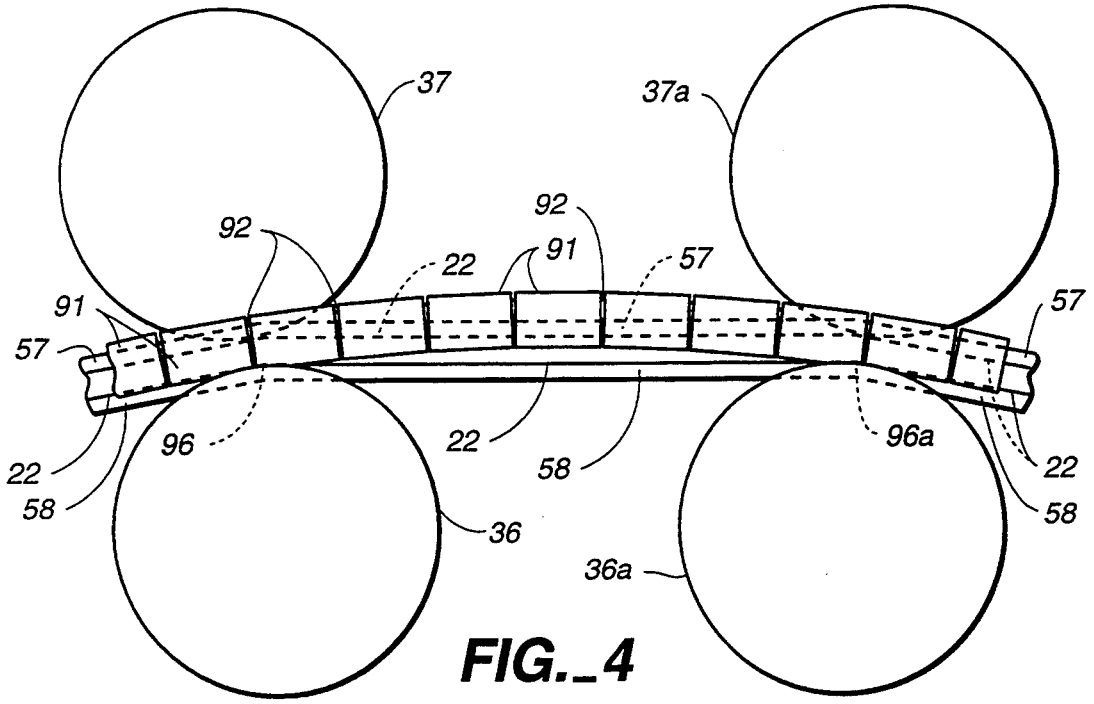
FIG. 4 is a schematic, top plan view of the traction element of FIG. 2 shown in a curved portion of a transit path.

Instead and as shown in FIG. 4, clamp assembly 86 can be provided, for example, by two or three clamps 86 proximate each of the wheel bogies of the vehicle.

Referring now to FIG. 5, a continuous loop transit path 23 is shown in which for stations, 96–99 are positioned equidistant from each other along path 23. As will be appreciated, the transit or transport system of the present invention can take numerous other forms, including out and back loops shuttle loop paths and single shuttle systems. Station spacing preferably causes each train of vehicles 21 to simultaneously stop at a station, but it also would be possible to simply keep the vehicle doors closed if a train stopped at a non-station. As also will be seen a single drive wheel can be employed on the inside of curved areas of the path, but then the conventional tension, contact angle and coefficient of friction factors determine torque transfer. The present drive belt nevertheless will have a width contact advantage over haul ropes.

As will be apparent from the foregoing description of the apparatus of the present invention, the method of driving vehicle 21 in a transit system of the present invention is comprised of the step of applying a traction force to the vehicle sufficient to propel the vehicle along transit path 23 through a flexible, elongated traction belt or band coupled to the vehicle. Moreover, during the step of applying the traction force, traction belt 22 is preferably supported in a near vertical orientation and opposite sides 33 of traction belt 22 are driven by frictional engagement with opposed drive wheels 36 and 37. The traction belt affords a width dimension, W, enabling coupling, driving, and guiding of the belt at predetermined side-by-side locations which do not interfere with each other so that belt driving can be accomplished efficiently by small diameter drive wheels at virtually any location along transit path 23.

What is claimed is:

1. A transit system comprising:

a movable vehicle, an elongated flexible endless traction belt having planar opposite sides and extending along and defining a transit path having opposite ends, said traction belt being coupled to said vehicle to apply a traction force to said vehicle sufficient to propel said vehicle along said path, and a plurality of drive assemblies distributed in spaced apart locations periodically along said path intermediate said opposite ends and frictionally engaging said opposite sides of said traction belt at said locations and applying a frictional driving force to at least one of said opposite sides as the primary driving force for said belt and said vehicle to displace said traction belt and vehicle along said path.

2. The transit system as defined in claim 1 wherein, said vehicle is coupled to said traction belt proximate one edge thereof, and said drive assembly frictionally displaces said traction belt by engagement of said opposite sides of said traction belt at a position laterally of coupling of said vehicle to said traction belt.

3. The transit system as defined in claim 2, and a support assembly supporting said traction belt for movement along said path in a near vertical orientation and guiding said traction belt against displacement in a vertical direction parallel to opposed sides of said belt.

4. The transit system as defined in claim 3 wherein, said traction belt is provided with a longitudinally extending guide shoe proximate an edge of said traction belt opposite said edge having said vehicle coupled thereto, and said support assembly engages said guide shoe for guiding of said traction belt.

5. The transit system as defined in claim 4 wherein, said guide shoe is formed with a substantially triangular cross section providing a base guide surface and two oppositely facing sloping guide surfaces positioned on opposite sides of said belt.

6. The transit system as defined in claim 5 wherein, said support assembly includes a plurality of first guide rollers positioned in spaced relation along said path and rollingly engaging said base guide surface proximate an edge of said traction belt, and a plurality of second guide rollers positioned in spaced relation along said path and rollingly engaging said two sloping guide surfaces.

7. The transit system as defined in claim 1 wherein said drive assemblies are provided by a pair of drive wheels resiliently biased toward each other on opposite sides of said traction belt.

8. The transit system as defined in claim 1 wherein, said traction belt is provided by a flexible rubber-impregnated belt having a plurality of longitudinally extending metallic reinforcing strands therein.

9. The transit system as defined in claim 1 wherein, said vehicle is coupled to one edge of said traction belt by a longitudinally extending coupling assembly, said coupling assembly being resiliently flexible transverse to a longitudinal axis thereof with a resistance to transverse flexing greater than the resistance of said traction belt to transverse flexing.

10. The transit system as defined in claim 9 wherein, said coupling assembly is provided by a plurality of side-by-side bands each having a dimension along said traction belt less than a width dimension of said traction belt, said bands being coupled to said belt and encircling and radially inwardly gripping a resiliently flexible elongated flexure member extending along said edge of said traction belt.

11. The transit system as defined in claim 10 wherein, said coupling assembly includes a sufficient number of said bands to extend along said traction belt over a distance at least about equal to a length of said vehicle.

12. The transit system as defined in claim 11 wherein, said coupling assembly further includes at least one clamping assembly extending between and coupling said flexure member to said vehicle.

13. A passenger conveying transit system comprising:

an elongated endless flexible resiliently compressible traction belt having opposite planar sides extending along a transit path;

a belt support assembly supporting said traction belt for movement along said path with said belt oriented with said opposed sides thereof in a near vertical plane;

a vehicle formed for transport of a load and coupled to said traction belt for propulsion thereby; and a plurality of spaced apart drive assemblies positioned intermediate opposed ends of said path and frictionally engaging said opposite sides to drive said traction belt along said path.

14. The transit system as defined in claim 13 wherein, said plurality of drive assemblies is provided by a plurality of pairs of drive wheels mounted on opposite sides of said traction belt at spaced intervals along said path, said pairs of drive wheels being movably mounted and biased toward each other and into frictional engagement with opposite sides of said belt.

15. The transit system as defined in claim 14 wherein, said traction belt is coupled to an underneath side of said vehicle along an upper edge of said traction belt, and said drive wheels engage said sides of said traction belt below coupling of said vehicle to said traction belt.

16. The transit system as defined in claim 15, and a plurality of belt supporting rollers positioned to and engaging said belt at intervals over the length thereof along horizontally extending surfaces for controlled guiding of the vertical position of said belt along said path.

17. The transit system as defined in claim 16 wherein, said belt supporting rollers include rollers applying guiding forces to said belt in both an upward direction and a downward direction.

18. The transit system as defined in claim 13 wherein, said plurality of drive assemblies is formed to drive said vehicle completely around a continuous loop transit path.

19. A method of propelling a vehicle in a transit system including an endless traction element coupled to said vehicle and supported for movement along a path comprising the steps of:

providing said traction element as an endless traction belt;

coupling said vehicle to said traction belt at a predetermined coupling position along a width dimension of said traction belt, and driving said belt along said path by frictionally engaging and displacing said traction belt at a driving position laterally adjacent said coupling position and at a plurality of spaced apart locations along said path.

20. The method as defined in claim 19 wherein, said driving step is accomplished while said traction belt is oriented with opposed sides in a substantially vertical plane.

* * * * *